US010858087B2

(12) United States Patent
Provost

(10) Patent No.: US 10,858,087 B2
(45) Date of Patent: Dec. 8, 2020

(54) VERTICAL-INPUT OUTBOARD-MOTOR FORWARD-REVERSE ANGLED-DRIVE LOWER UNIT

(71) Applicant: Brian Provost, Loreauville, LA (US)

(72) Inventor: Brian Provost, Loreauville, LA (US)

( * ) Notice: Subject to any disclaimer, the term of this patent is extended or adjusted under 35 U.S.C. 154(b) by 0 days.

(21) Appl. No.: 16/908,326

(22) Filed: Jun. 22, 2020

(65) Prior Publication Data

US 2020/0317316 A1 Oct. 8, 2020

Related U.S. Application Data

(63) Continuation-in-part of application No. 15/834,797, filed on Dec. 7, 2017, now Pat. No. 10,690,197.

(51) Int. Cl.
*B63H 20/20* (2006.01)

(52) U.S. Cl.
CPC ..... *B63H 20/20* (2013.01)

(58) Field of Classification Search
CPC ..... B63H 20/20; F16D 28/00; F16D 11/14
See application file for complete search history.

(56) References Cited

U.S. PATENT DOCUMENTS 3,703,642 A * 11/1972 Balaguer ..... B63J 3/00 290/43
4,946,411 A * 8/1990 Novey ..... B63H 21/22 440/84
5,072,629 A * 12/1991 Hirukawa ..... B63H 21/213 338/47
5,348,500 A * 9/1994 Lassanske ..... B63H 20/245 440/86
5,692,931 A * 12/1997 Kawai ..... F02B 61/045 440/86
6,352,457 B1 * 3/2002 Higby ..... B63H 21/213 440/86
2016/0090165 A1 * 3/2016 Suzuki ..... B63H 20/12 440/87
2019/0178309 A1 * 6/2019 Provost ..... F16D 28/00

* cited by examiner

*Primary Examiner* — Lars A Olson
*Assistant Examiner* — Jovon E Hayes
(74) *Attorney, Agent, or Firm* — Keaty Law Firm LLC

(57) ABSTRACT

A vertical-input outboard-motor angled-drive lower unit apparatus and method for improved operations in shallow, muddy, marshy water or water choked with vegetation or obstacles. Vertically applied single-direction rotational power from an outboard motor engine is transferred to operator-controlled forward and reverse rotational power applied at an acute angle to the horizontal water surface. The apparatus is cooled by an external flow of water without being taken into any port which might become blocked. A thrust redirection plate reflects otherwise wasted propeller thrust, especially when operating in reverse, for more efficient operation and reduced churning of the water surface. An angled skeg and the angled orientation of the output shaft and housing deflect obstructions.

20 Claims, 13 Drawing Sheets

VERTICAL-INPUT OUTBOARD-MOTOR FORWARD-REVERSE ANGLED-DRIVE LOWER UNIT

CROSS-REFERENCE TO RELATED APPLICATIONS

This application is a continuation-in-part of co-pending application Ser. No. 15/834,797 filed on Dec. 7, 2017, the full disclosure of which is incorporated by reference herein and priority of which is hereby claimed.

BACKGROUND OF THE INVENTION

This invention provides a vertical-input outboard-motor angled-drive lower unit apparatus and method for improved operations.

Conventional outboard motors have performance deficiencies when operating in shallow, muddy, marshy water or water choked with vegetation or obstacles. The propellers are mounted perpendicular to the water surface and therefore must be submerged at least the full length of their diameters. The gearboxes are located immediately in front of the propellers and therefore must be submerged, placing a bulk of material under water where it generates drag. Cooling is achieved by taking water in through a port and circulating it, which can lead to corrosion and damage when used in salty or polluted water, and to blockage of the intake port and overheating when used in muddy or vegetation- or obstruction-filled water. When being operated in reverse, a significant portion of reverse thrust is directed toward the water surface where it meets the negligible resistance of air pressure and is wasted while churning up the water surface, or is directed toward the transom of the boat where that portion of the thrust is counteracted. The conventional outboard motors are subject to fouling and damage from obstructions, including thick vegetation and floating objects.

Typical shallow-water outboard motors are known, having an output shaft and propeller extending downward into the water at an angle. These shallow-water outboard motors have cumbersome gearboxes located entirely above the water line, where they are subject to overheating. The gearboxes are attached to the outboard-motor engine at the back of the engine and can only be driven by engines having a horizontal rotational output, excluding engines having a vertical rotational output. The gearing and connections of these shallow-water outboard motors make shifting between forward and reverse awkward and cumbersome and place the propeller at a long distance from the steering pivot point, making steering operations awkward and cumbersome. These typical shallow-water outboard motors, when operated in reverse, exhibit the same defects as the conventional outboard motor, with a significant portion of reverse thrust being wasted against the air and the transom, with churning at the surface, and are subject to fouling and damage from obstructions.

What is needed is an outboard-motor lower unit which utilizes engine power provided as vertically oriented rotation, which provides output at an angle to the water surface, which provides water cooling without blockage or internal corrosion, which provides easy and efficient shifting from forward to reverse, which provides a smaller distance from the steering pivot point to the propeller, which shields against damage or fouling by objects in the water, and which redirects otherwise wasted thrust, especially in reverse, into useful thrust without churning the water surface.

SUMMARY OF THE INVENTION

This invention provides a vertical-input outboard-motor angled-drive lower unit apparatus and method for improved operations especially in shallow, muddy, marshy water or water choked with vegetation or obstacles. Vertically applied single-direction rotational power from an outboard motor engine is transferred to operator-controlled forward and reverse rotational power applied at an acute angle to the horizontal water surface. The apparatus is cooled by an external flow of water without being taken into any port which might become blocked. A thrust redirection plate reflects otherwise wasted propeller thrust, especially when operating in reverse, for more efficient operation and reduced churning of the water surface. An angled skeg and the angled orientation of the output shaft and housing deflect obstructions.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
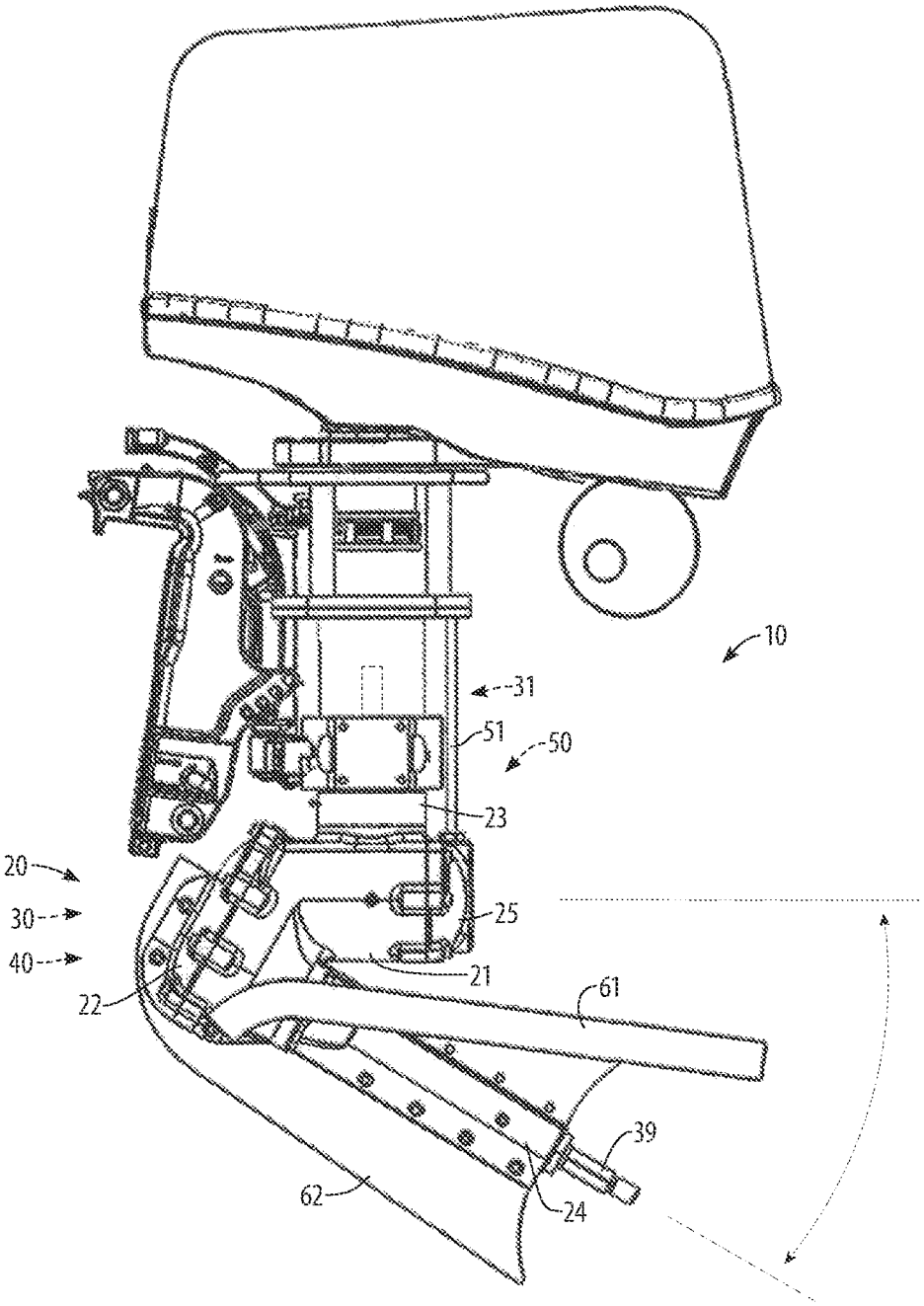
FIG. 1 is a side view of the vertical-input outboard-motor angled-drive lower unit of the invention.
Figure 2:
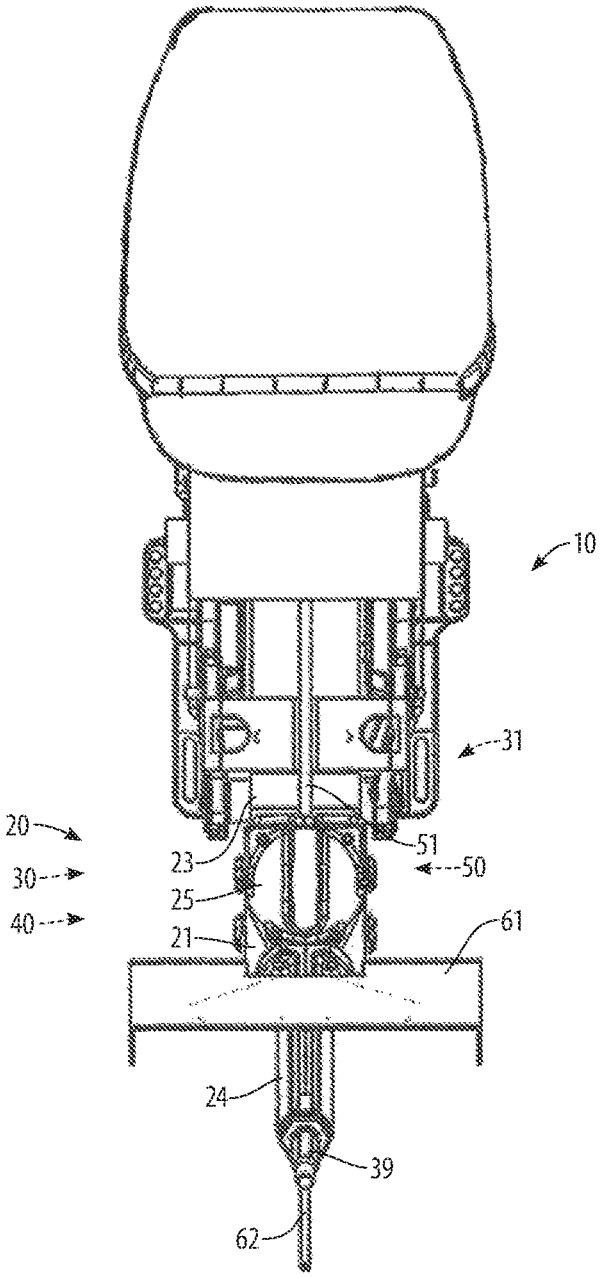
FIG. 2 is a rear view of the vertical-input outboard-motor angled-drive lower unit of the invention.
Figure 3:
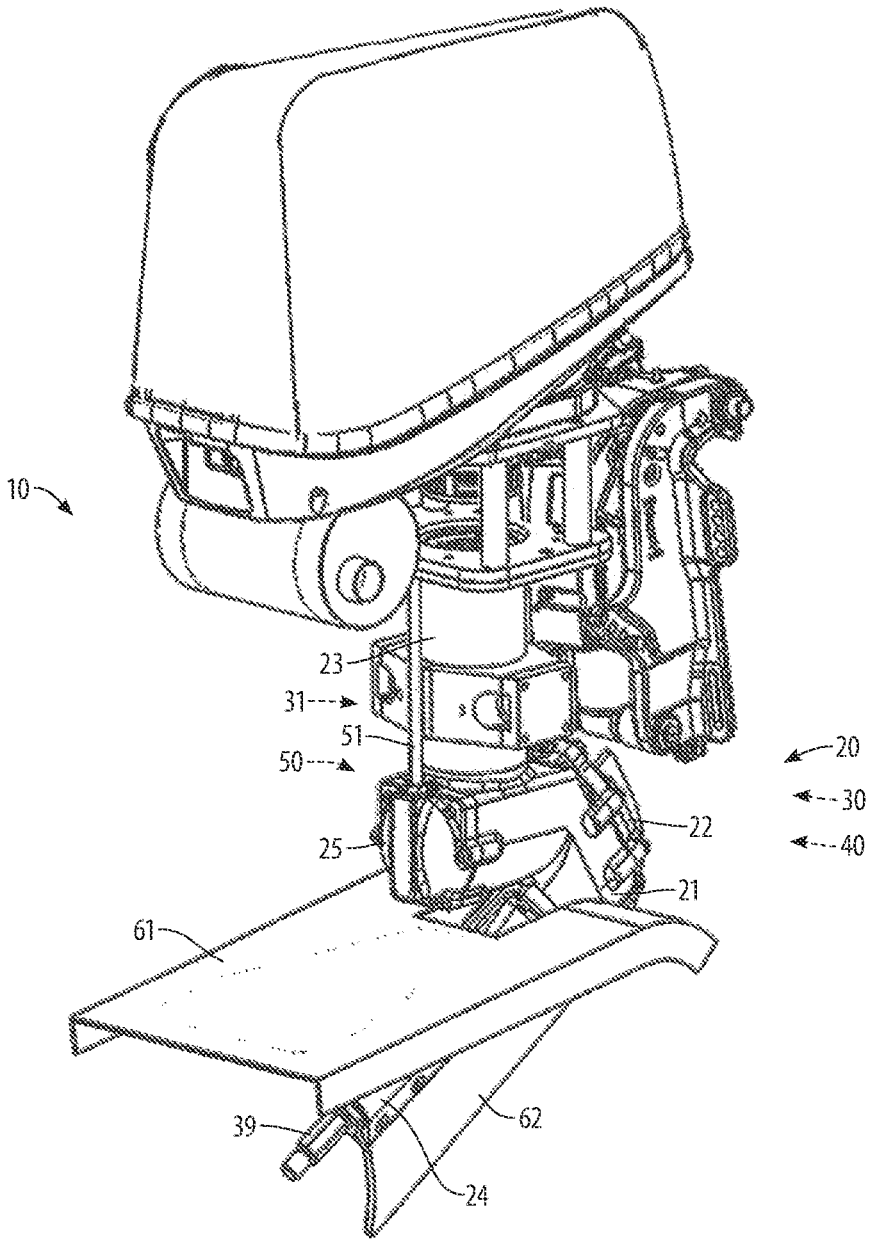
FIG. 3 is a perspective view of the vertical-input outboard-motor angled-drive lower unit of the invention.
Figure 4:
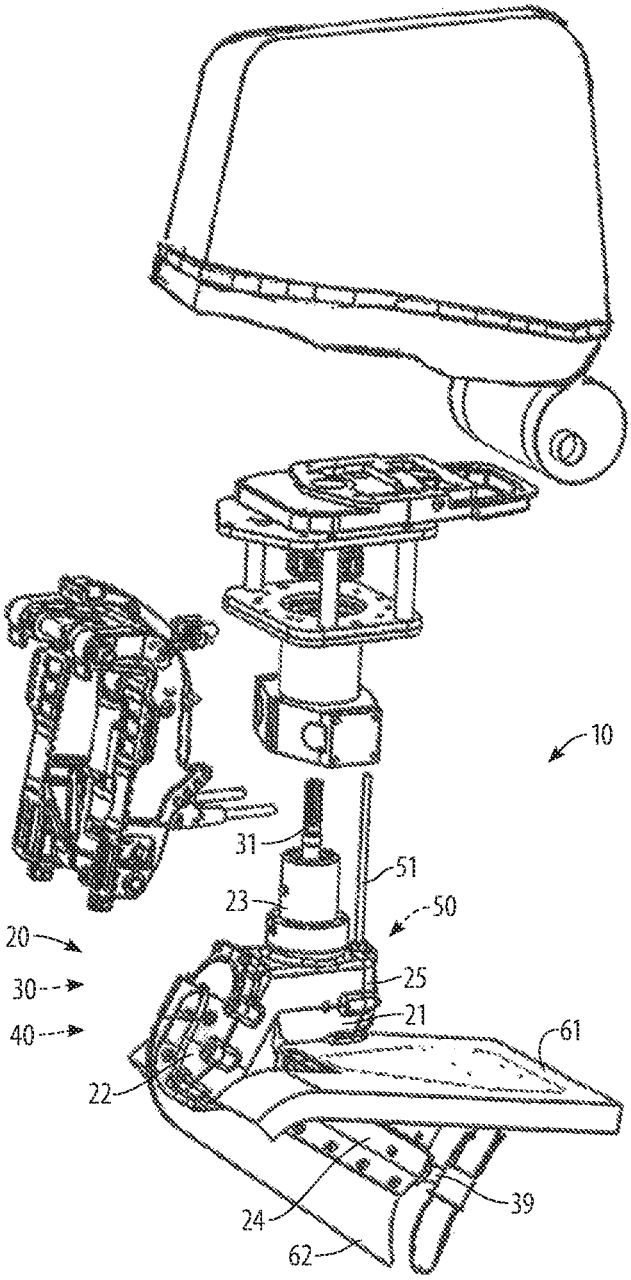
FIG. 4 is a partially exploded view of the vertical-input outboard-motor angled-drive lower unit of the invention.

Referring to FIGS. 1-4, the vertical-input outboard-motor forward-reverse angled-drive lower unit 10 provides the lower unit for an outboard boat motor especially suited for operation in shallow, muddy, marshy, or vegetation- or obstacle-choked waters.

The vertical-input outboard-motor angled-drive lower unit 10 uses rotational force supplied by the outboard-motor engine to a vertical input shaft 31 and transfers either the force or the reversed rotational direction of the force to the propeller mount 39, which is angled away from the vertical orientation of the vertical input shaft 31. A propeller mounted on the propeller mount 39 is at an acute angle to the surface and presumably to the bottom of the water. The preferred angle is 30 degrees from horizontal. At this angle, a propeller will only require a vertical clearance of half its diameter, for example, a 10-inch diameter propeller will only require a 5-inch depth of water. A thrust redirection plate 61 is provided, above the mounted propeller and at a less-acute angle to the surface of the water. When the propeller is thrusting to the rearward and downward, pushing the boat forward, the thrust redirection plate reflects the peripheral part of that force away from breaking the surface of the water and being wasted. When the propeller is thrusting to the forward and upward, pulling the boat rearward, the thrust redirection plate reflects the main part of that force, which is initially directed toward the surface of the water and the transom of the boat, into a downward-angled, more efficient thrust. An angled skeg 62 is provided to shield the vertical-input outboard-motor angled-drive lower unit 10 and the mounted propeller.

The vertical-input outboard-motor angled-drive lower unit 10 provides housings 20 enclosing geared shafts 30 and bearings 40. Most of the parts of the housings 20 sit at least partially below the water line during use, which serves to keep the vertical-input outboard-motor angled-drive lower unit 10 cool during use. This cooling provides an advantage over the prior art, where some components are located above the water line and are essentially not cooled, or are cooled by water being taken into ports, which is a less-desirable solution when operating in salty or otherwise corrosive or polluted water or in muddy, vegetation-choked, or otherwise obstruction-filled water, where a water-intake port might become blocked and result in overheating. An angled main housing 21, forward housing 22, input shaft housing 23 output shaft housing 24 and rear housing 25 are provided.

The vertical-input outboard-motor angled-drive lower unit 10 provides a direction-shifting unit 50 which provides improvements over the prior art. A shift actuator rod 51 provides operator control for shifting between forward and reverse gears. Other components of the direction-shifting unit 50 are housed within the rear housing 25 and are consequently at least partially below the water line and are cooled.

Figure 5:
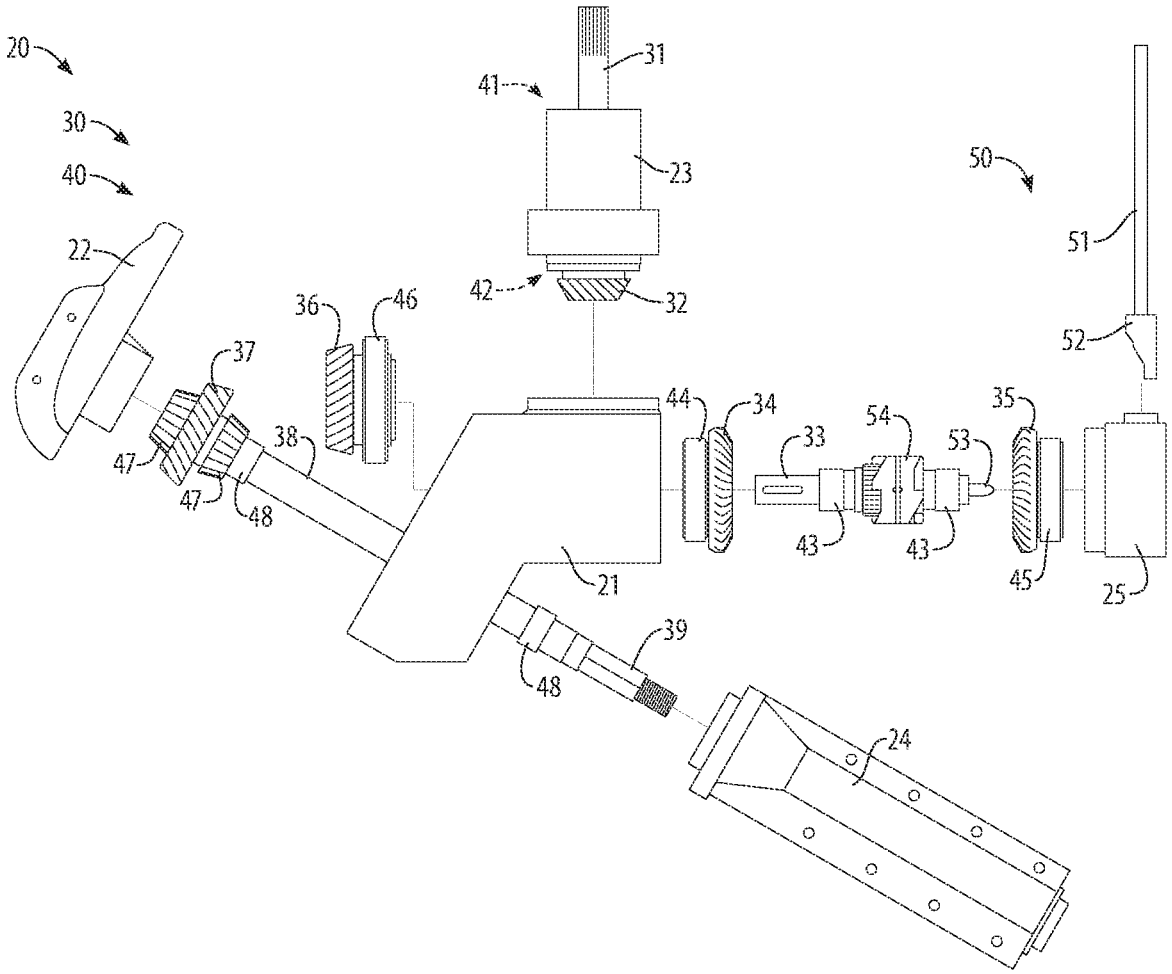
FIG. 5 is an exploded view of the vertical-input outboard-motor angled-drive lower unit of the invention.
Figure 6:
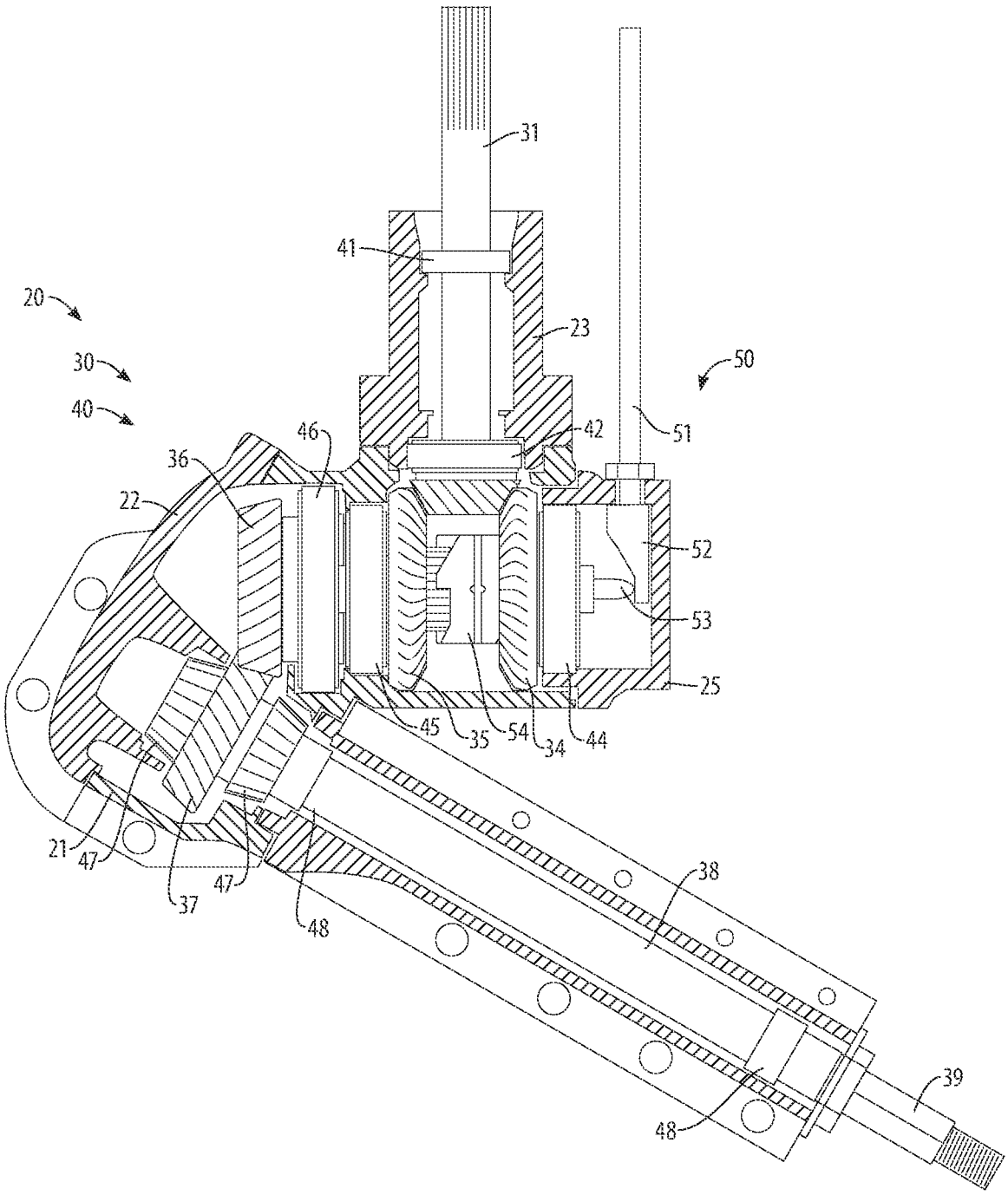
FIG. 6 is a side cutaway view of the vertical-input outboard-motor angled-drive lower unit of the invention.
Figure 7:
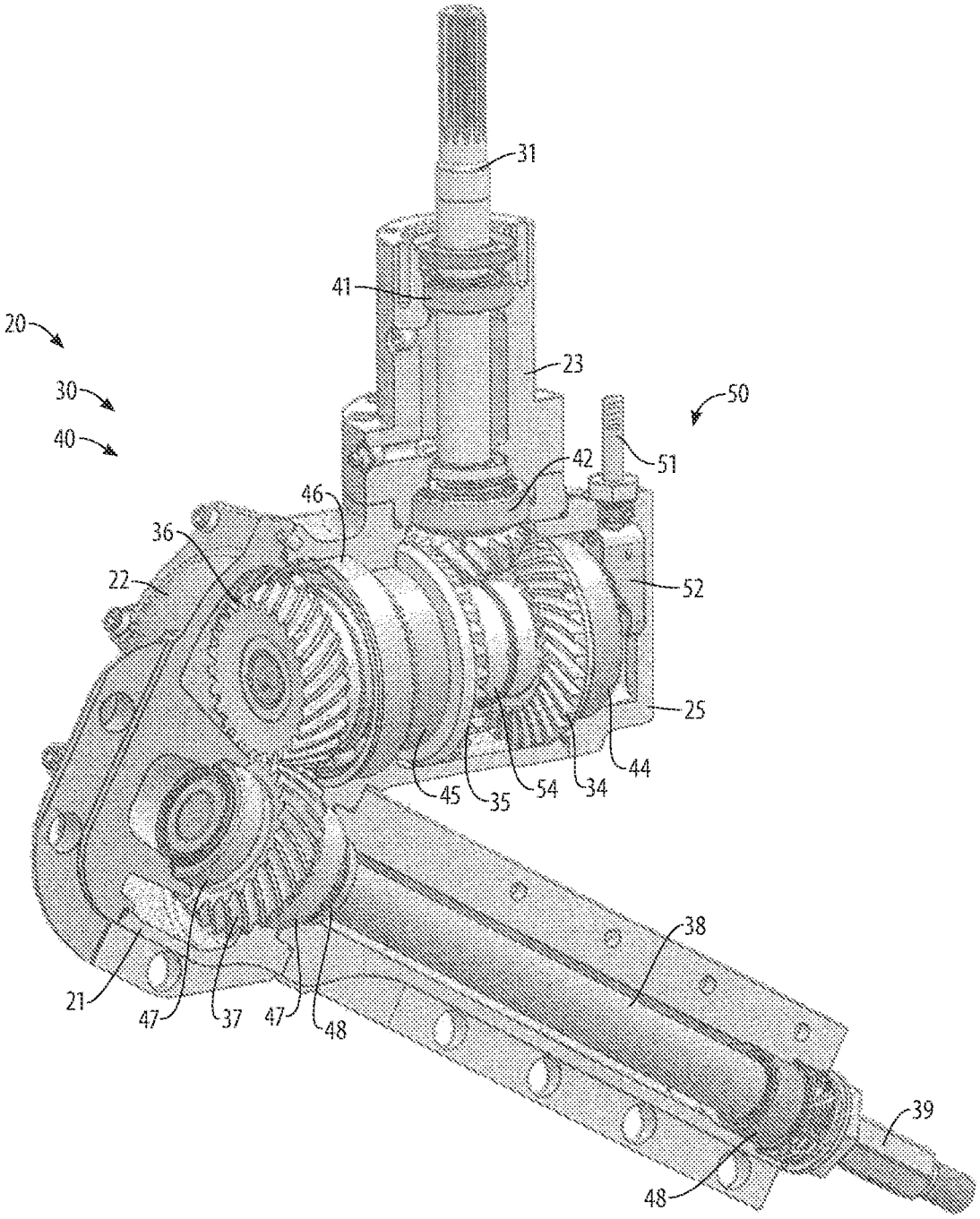
FIG. 7 is a perspective cutaway view of the vertical-input outboard-motor angled-drive lower unit of the invention.

Referring to FIGS. 5-7, the vertical-input outboard-motor angled-drive lower unit 10 provides the housings 20 as identified above, and provides geared shafts 30 and corresponding bearings 40 to transfer vertically oriented single-direction forward-only rotational force from the outboard-motor engine to angle-oriented forward or reverse rotational force to a mounted propeller. A vertical input shaft 31 with input shaft bearing 41 enclosed within the input shaft housing 23 takes power in the form of single-direction rotational force from the engine of the outboard motor. An input gear 32 with input gear bearing 42 at the lower end of the vertical input shaft 31 rotates with the shaft and is configured to transfer the force at a right angle to a correspondingly configured gear. A bevel gear is appropriate for this purpose, with other gearing being possible.

An intermediate shaft 33 with intermediate shaft bearings 43 is provided, enclosed primarily within the angled main housing 21, located below and at a right angle to the vertical input shaft 31, therefore running horizontally, and running from a forward end to a rearward end in relation to the direction of travel of the outboard motor in use. Around the intermediate shaft 33 in a freely rotating manner are mounted a forward gear 34 with forward gear bearing 44 and a reverse gear 35 with reverse gear bearing 45. The forward gear 34 and the reverse gear 35 are each mounted facing inward toward the middle of the intermediate shaft 33 and therefore each facing the other. Both the forward gear 34 and the reverse gear 35 make contact with the input gear 32 and continually rotate with the input gear 32. In use, the forward gear 34 rotates in a direction yielding a propeller rotation producing a forward thrust, and the reverse gear 35 rotates in the opposite direction yielding a propeller rotation producing a reverse thrust.

The intermediate shaft can be rotated either in a forward direction by the forward gear 34 or in a reverse direction by the reverse gear 35. The direction-shifting unit 50 controls which gear is engaged with the intermediate shaft 33, under the control of an operator using the shift actuator rod 51, which moves a shifting wedge 52 enclosed within the rear housing 25. A shifting clutch dog 54 mounted upon the intermediate shaft 33 between the forward gear 34 and the reverse gear 35 engages with either the forward gear 34 or the reverse gear 35 and transfers the rotation of the engaged gear to the intermediate shaft 33. A clutch dog actuator pin 53 is mounted at the rearward end of the intermediate shaft 33. The clutch dog actuator pin 53 makes contact with the shifting wedge 52 and changes position corresponding to the portion of the shifting wedge 52 being contacted. The change of position of the clutch dog actuator pin 53 is transferred to a change of position of the shifting clutch dog 54 such that the shifting clutch dog 54 changes between engaging either the forward gear 34 or the reverse gear 35, thereby shifting the rotational direction of the intermediate shaft 33.

A driving bevel gear 36 with driving bevel gear bearing 46 is mounted at the forward end of the intermediate shaft 33. This driving bevel gear 36 rotates with the intermediate shaft, either in a forward or reverse direction according to the operation of the direction-shifting unit 50.

An output shaft 38 with output shaft bearings 48 is provided below, in line with, and at an acute angle to the intermediate shaft 33. As stated above, the preferred angle is 30 degrees from horizontal, which is 120 degrees from the vertical line of the vertical input shaft 31.

A driven bevel gear 37 with driven bevel gear bearings 47 is mounted at the forward upward end of the output shaft 38. Together, the driving bevel gear 36 and the driven bevel gear 37 transfer the rotational force of the intermediate shaft 33 to the output shaft 38, at an acute angle. The rotational force transferred can be either a forward-thrust producing force or a reverse-thrust producing force.

The rotational force applied to the output shaft 38 is transferred through the propeller mount 39 to a mounted propeller, producing the corresponding forward or reverse thrust.

Figure 8:
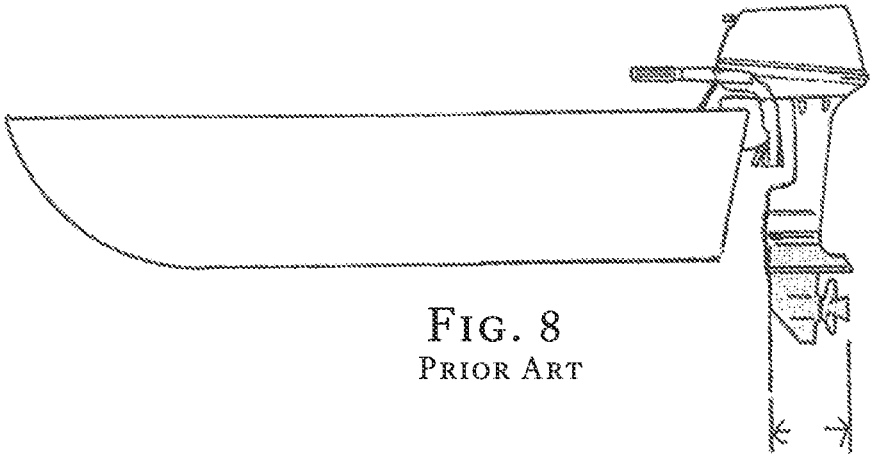
FIG. 8 PRIOR ART
FIG. 8 is a schematic view of a prior-art conventional outboard motor in use.
Figure 9:
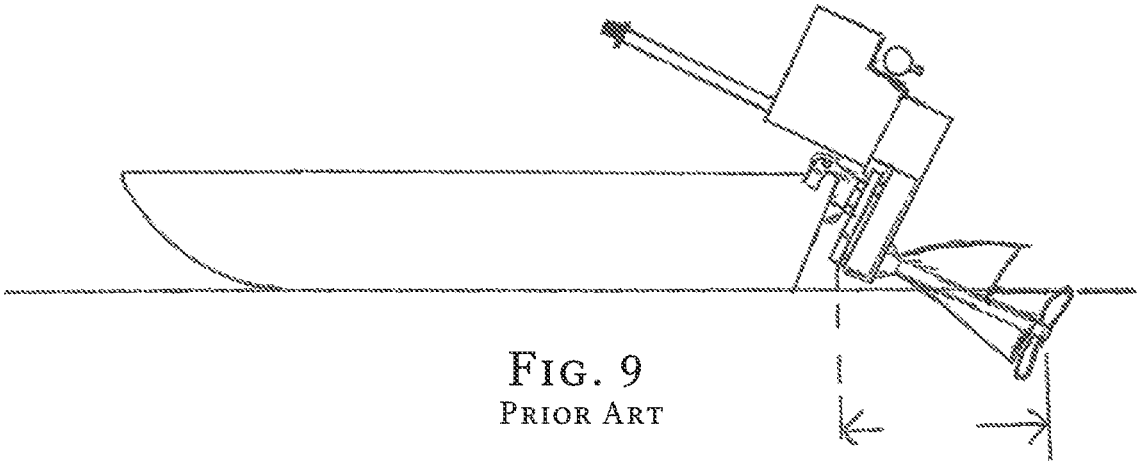
FIG. 9 PRIOR ART
FIG. 9 is a schematic view of a prior-art typical shallow-water outboard motor in use.
Figure 10:
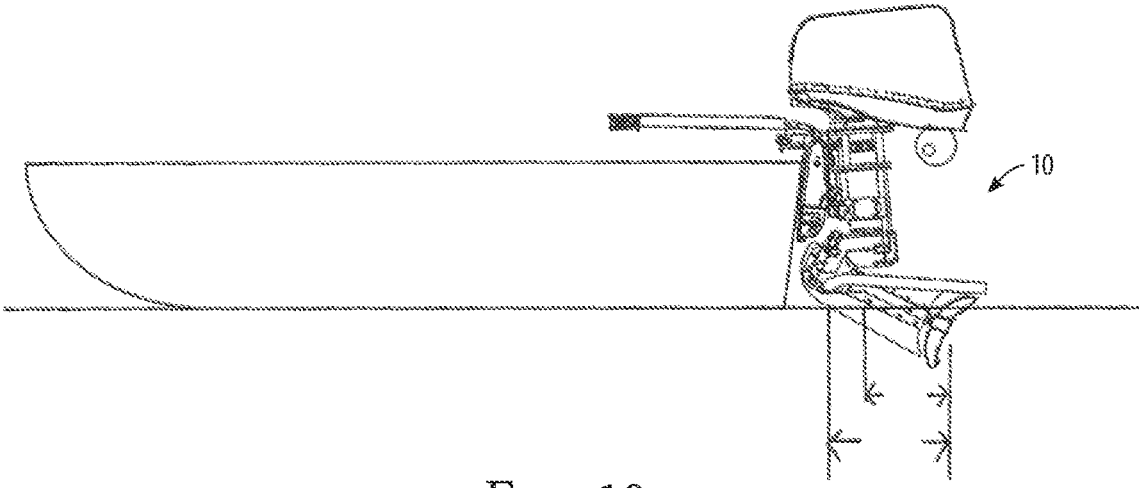
FIG. 10 is a schematic view of the vertical-input outboard-motor angled-drive lower unit of the invention in use.

Referring to FIGS. 8-10, the distance from the steering pivot point to the propeller of an outboard motor using the vertical-input outboard-motor angled-drive lower unit 10 is close to that of a conventional outboard motor and is significantly shorter than that of a typical shallow-water outboard motor. The shorter distance yields easier and better operation.

Figure 11:
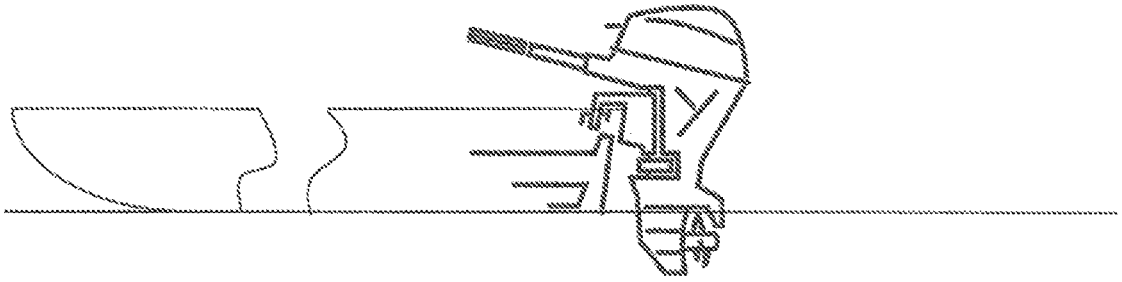
FIG. 11 PRIOR ART
FIG. 11 is a schematic view of a prior-art conventional outboard motor in use.
Figure 12:
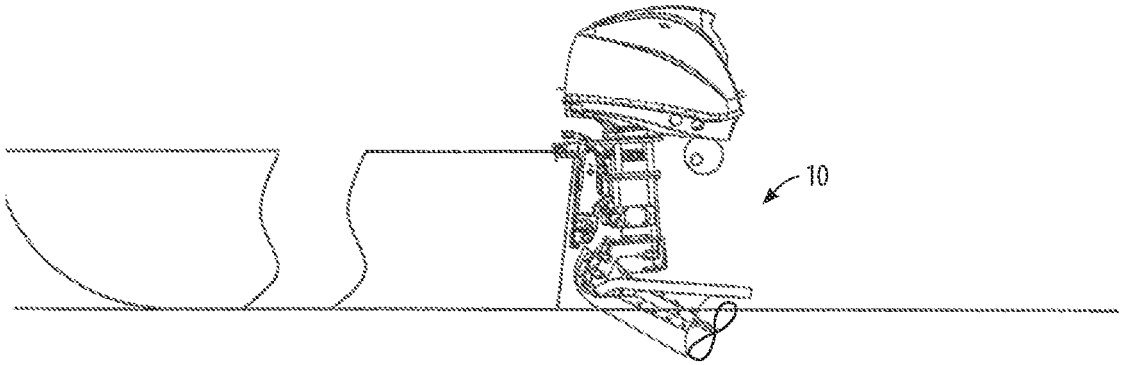
FIG. 12 is a schematic view of the vertical-input outboard-motor angled-drive lower unit of the invention.

Referring to FIGS. 11 and 12, when it is desirable or necessary to raise the motor such as through the use of a "jackplate," an outboard motor using the vertical-input outboard-motor angled-drive lower unit 10 will have the bulk of its gearbox housing above the water, reducing drag as compared to a convention outboard motor having its entire gearbox under water.

Figure 13:
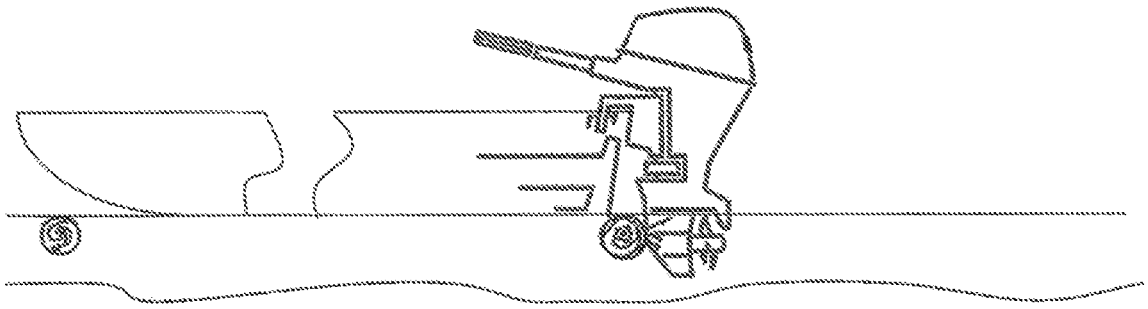
FIG. 13 PRIOR ART
FIG. 13 is a schematic view of a prior-art conventional outboard motor in use.
Figure 14:
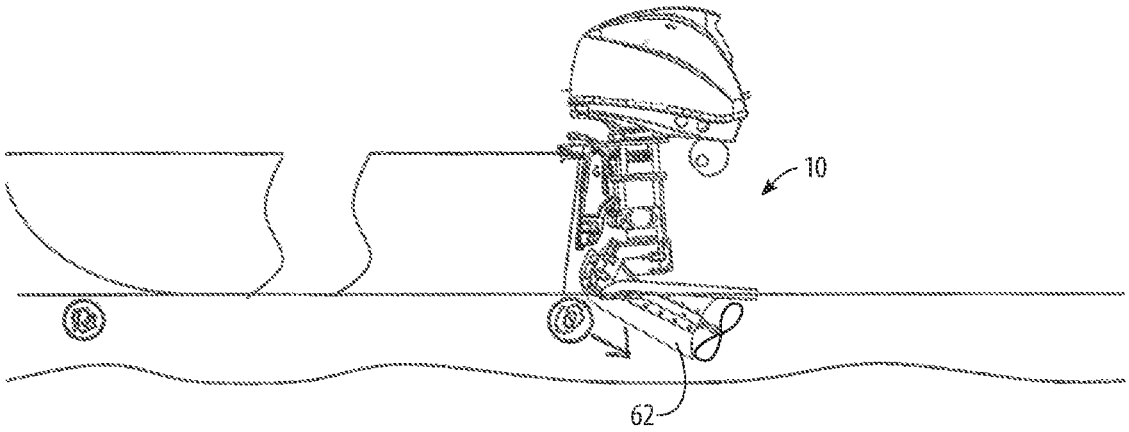
FIG. 14 is a schematic view of the vertical-input outboard-motor angled-drive lower unit of the invention.

Referring to FIGS. 13 and 14, an outboard motor using the vertical-input outboard-motor angled-drive lower unit 10 will negotiate floating obstructions more easily than a conventional outboard motor where the angled skeg 62, and the angled orientation of the lower portions generally, shield a mounted propeller from damage or fouling by deflecting obstructions.

Figure 15:
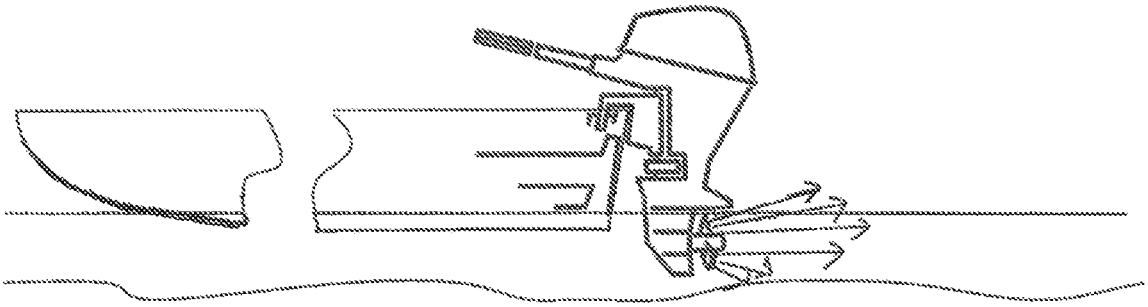
FIG. 15 PRIOR ART
FIG. 15 is a schematic view of a prior-art conventional outboard motor in use.
Figure 16:
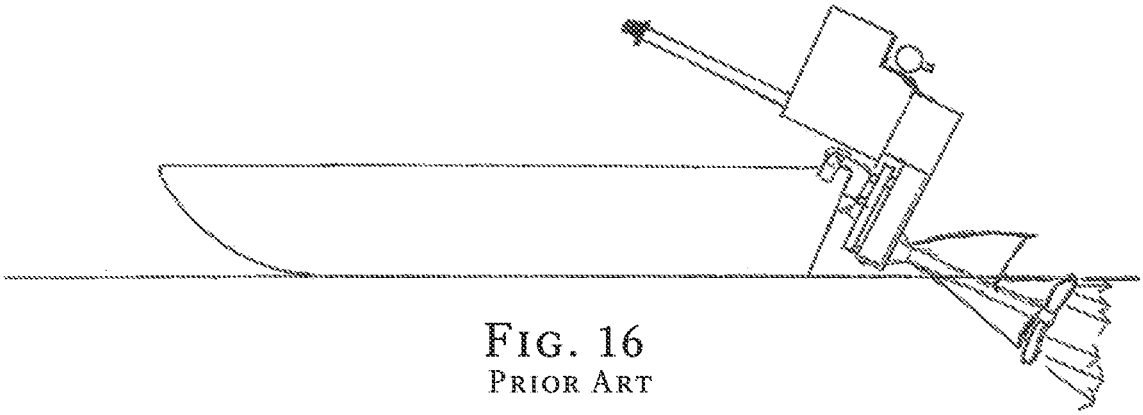
FIG. 16 PRIOR ART
FIG. 16 is a schematic view of a prior-art typical shallow-water outboard motor in use.
Figure 17:
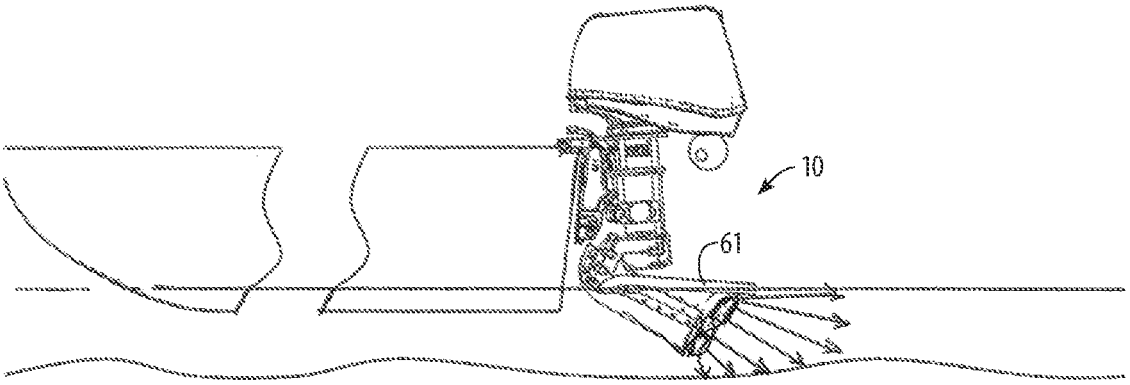
FIG. 17 is a schematic view of the vertical-input outboard-motor angled-drive lower unit of the invention.
Figure 18:
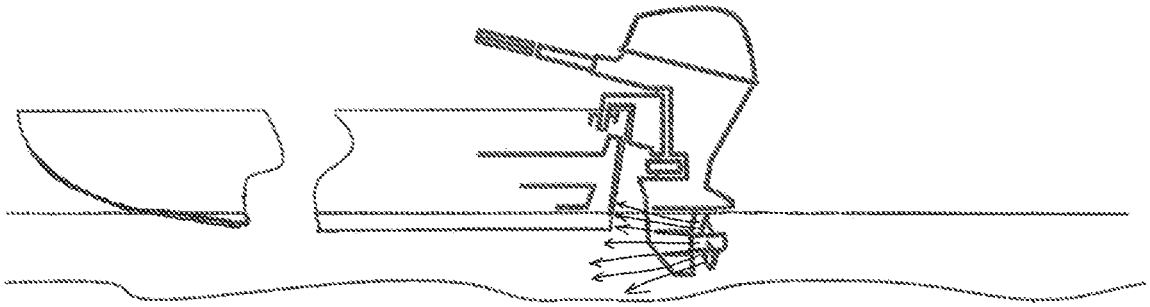
FIG. 18 PRIOR ART
FIG. 18 is a schematic view of a prior-art conventional outboard motor in use.
Figure 19:
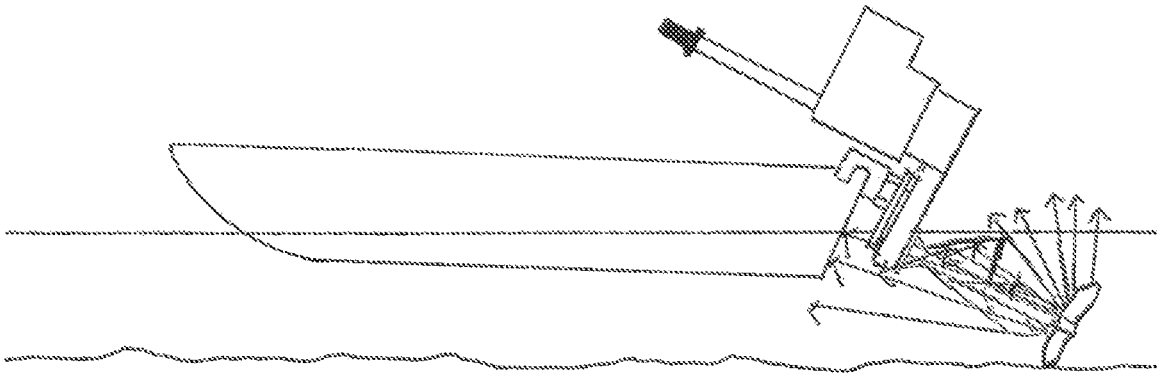
FIG. 19 PRIOR ART
FIG. 19 is a schematic view of a prior-art typical shallow-water outboard motor in use.
Figure 20:
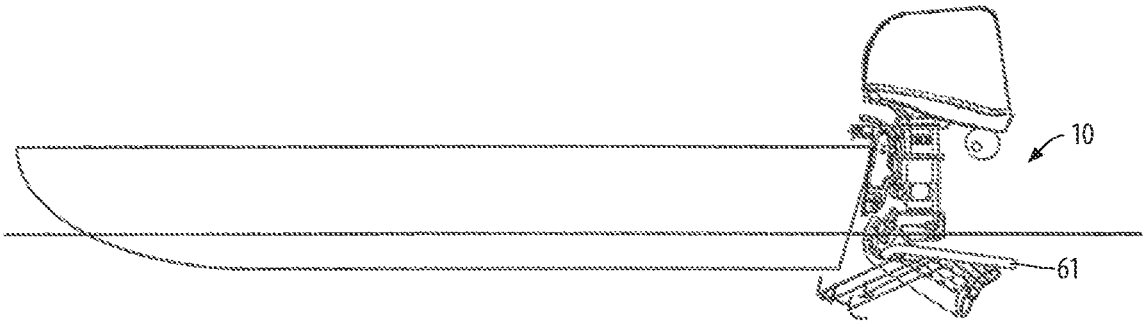
FIG. 20 is a schematic view of the vertical-input outboard-motor angled-drive lower unit of the invention.
Figure 21:
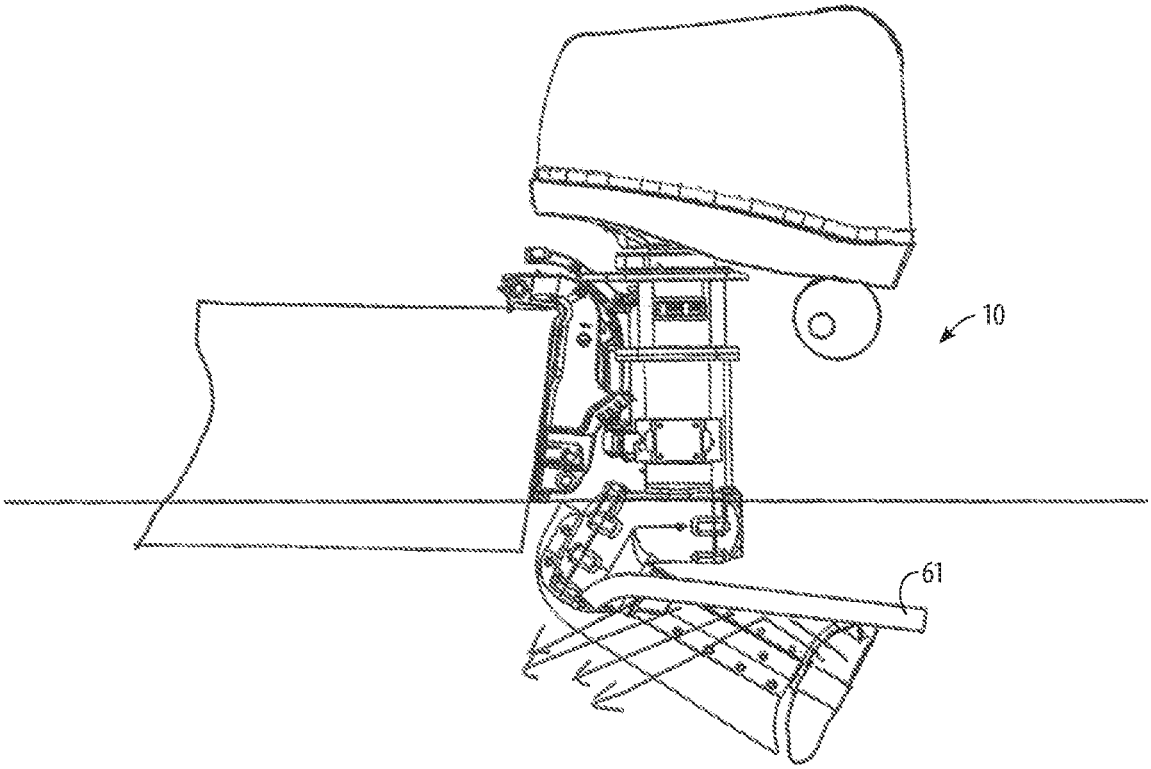
FIG. 21 is a schematic view of the vertical-input outboard-motor angled-drive lower unit of the invention in use.

Referring to FIGS. 15-17, an outboard motor using the vertical-input outboard-motor angled-drive lower unit 10 will operate more efficiently in forward gear than a conventional outboard motor because the thrust redirection plate 61 prevents thrust from being directed upward against the negligible air pressure, and therefore wasted, and the downward-angled orientation of the thrust can operate against the bottom, in shallow water, and against the increased pressure of deeper water otherwise.

Referring to FIGS. 18-21, whereas the reverse thrust of a conventional outboard motor and a typical shallow-water outboard motor is partially directed against the air, where it is wasted, or against the transom, where it is counteracted, the reverse thrust of an outboard motor using the vertical-input outboard-motor angled-drive lower unit 10 is reflected by the thrust redirection plate 61 to channel the otherwise-wasted thrust into useful thrust. The thrust redirection plate 61 also prevents churning of the water surface when operating in reverse.

Many other changes and modifications can be made in the system and method of the present invention without departing from the spirit thereof. I therefore pray that my rights to the present invention be limited only by the scope of the appended claims.

I claim:

1. A vertical-input outboard-motor angled-drive lower unit apparatus comprising:

(i) a vertical input shaft adapted to accept rotational force from an outboard-motor engine at an upper end;

(ii) an input gear at the lower end of said vertical input shaft adapted to transmit rotational force at a right angle;

(iii) an intermediate shaft below and at a right angle to said vertical input shaft, having a forward and rearward orientation;

(iv) a forward gear mounted around said intermediate shaft, facing inward toward the middle of said intermediate shaft, adapted to engage said input gear and rotate in a first rotational direction;

(v) a reverse gear mounted around said intermediate shaft, facing inward toward the middle of said intermediate shaft, adapted to engage said input gear and rotate in a second rotational direction opposite the first;

(vi) a driving bevel gear mounted upon said intermediate shaft at the forward end, adapted to transmit rotational force at an acute angle;

(vii) an output shaft below and at an acute angle to said intermediate shaft, having a forward and rearward orientation;

(viii) a driven bevel gear mounted upon said output shaft at the forward end, adapted to engage said driving bevel gear at an acute angle and to rotate said output shaft in a corresponding rotational direction;

(ix) a propeller mount at the rearward end of said output shaft, adapted to drive a mounted propeller in the rotational direction applied to said output shaft;

(x) a shifting clutch dog mounted upon said intermediate shaft between said forward gear and said reverse gear, adapted to move along said intermediate shaft to engage with either said forward gear or said reverse gear, and to apply the directional rotational force from the engaged gear to said intermediate shaft;

(xi) a clutch dog actuator pin mounted at the rearward end of said intermediate shaft, adapted to move said shifting clutch dog along said intermediate shaft into engagement with either said forward gear or said reverse gear;

(xii) a shifting wedge adapted to move said clutch dog actuator pin such that said shifting clutch dog engages either said forward gear or said reverse gear;

(xiii) a shift actuator rod extending upward above the water line from said shifting wedge, adapted to provide controlled positioning of said shifting wedge;

(xiv) an input shaft housing adapted to enclose said vertical input shaft;

(xv) an angled main housing mounted to said input shaft housing, at least partially below the water line, adapted to enclose and cool said intermediate shaft and a portion of said output shaft;

(xvi) a forward housing mounted to said angled main housing at least partially below the water line, adapted to enclose and cool the forward ends of said intermediate shaft and said output shaft;

(xvii) a rear housing mounted to said angled main housing at least partially below the water line, adapted to enclose and cool the rearward end of said intermediate shaft and said shifting wedge;

(xviii) an output shaft housing mounted to said angled main housing below the water line, corresponding to the acute downward and rearward angle of said output shaft, adapted to enclose and cool the rearward portion of said output shaft;

(xix) a thrust redirection plate mounted upon and above said output shaft housing, at an acute angle, adapted to reflect and redirect force from a propeller mounted to said propeller mount; and (xx) an angled skeg mounted upon and below said forward housing, angled main housing, and output shaft housing, adapted to shield said vertical-input outboard-motor angled-drive lower unit and a mounted propeller from obstacles and shallow water bottoms.

2. The vertical-input outboard-motor angled-drive lower unit apparatus of claim 1, further comprising said output shaft below and at an acute angle of from 20 to 40 degrees inclusive to said intermediate shaft.

3. The vertical-input outboard-motor angled-drive lower unit apparatus of claim 1, further comprising said output shaft below and at an acute angle of from 25 to 35 degrees inclusive to said intermediate shaft.

4. The vertical-input outboard-motor angled-drive lower unit apparatus of claim 1, further comprising said output shaft below and at an acute angle of 30 degrees to said intermediate shaft.

5. The vertical-input outboard-motor angled-drive lower unit apparatus of claim 1, where said input gear, said forward gear, and said reverse gear are bevel gears.

6. The vertical-input outboard-motor angled-drive lower unit apparatus of claim 1, where said input gear, said forward gear, and said reverse gear are spiral bevel gears.

7. The vertical-input outboard-motor angled-drive lower unit apparatus of claim 1, where said driving bevel gear and said driven bevel gear are spiral bevel gears.

8. The vertical-input outboard-motor angled-drive lower unit apparatus of claim 1, where said thrust redirection plate further comprises a substantially planar structure extending forward and rearward and laterally sufficiently to extend past the operating area of a propeller mounted to said propeller mount.

9. The vertical-input outboard-motor angled-drive lower unit apparatus of claim 1, where said thrust redirection plate further comprises a substantially planar structure extending at least 12 inches in a forward-rearward dimension and at least 10 inches laterally.

10. The vertical-input outboard-motor angled-drive lower unit apparatus of claim 1, where said angled skeg extends downward at an angle greater than the angle of said output shaft.

11. A vertical-input outboard-motor angled-drive lower unit method comprising:

(i) providing a vertical-input outboard-motor angled-drive lower unit apparatus comprising:

(a) a vertical input shaft adapted to accept rotational force from an outboard-motor engine at an upper end;

(b) an input gear at the lower end of said vertical input shaft adapted to transmit rotational force at a right angle;

(c) an intermediate shaft below and at a right angle to said vertical input shaft, having a forward and rearward orientation;

(d) a forward gear mounted around said intermediate shaft, facing inward toward the middle of said intermediate shaft, adapted to engage said input gear and rotate in a first rotational direction;

(e) a reverse gear mounted around said intermediate shaft, facing inward toward the middle of said intermediate shaft, adapted to engage said input gear and rotate in a second rotational direction opposite the first;

(f) a driving bevel gear mounted upon said intermediate shaft at the forward end, adapted to transmit rotational force at an acute angle;

(g) an output shaft below and at an acute angle to said intermediate shaft, having a forward and rearward orientation;

(h) a driven bevel gear mounted upon said output shaft at the forward end, adapted to engage said driving bevel gear at an acute angle and to rotate said output shaft in a corresponding rotational direction;

(i) a propeller mount at the rearward end of said output shaft, adapted to drive a mounted propeller in the rotational direction applied to said output shaft;

(j) a shifting clutch dog mounted upon said intermediate shaft between said forward gear and said reverse gear, adapted to move along said intermediate shaft to engage with either said forward gear or said reverse gear, and to apply the directional rotational force from the engaged gear to said intermediate shaft;

(k) a clutch dog actuator pin mounted at the rearward end of said intermediate shaft, adapted to move said shifting clutch dog along said intermediate shaft into engagement with either said forward gear or said reverse gear;

(l) a shifting wedge adapted to move said clutch dog actuator pin such that said shifting clutch dog engages either said forward gear or said reverse gear;

(m) a shift actuator rod extending upward above the water line from said shifting wedge, adapted to provide controlled positioning of said shifting wedge;

(n) an input shaft housing adapted to enclose said vertical input shaft;

(o) an angled main housing mounted to said input shaft housing, at least partially below the water line, adapted to enclose and cool said intermediate shaft and a portion of said output shaft;

(p) a forward housing mounted to said angled main housing at least partially below the water line, adapted to enclose and cool the forward ends of said intermediate shaft and said output shaft;

(q) a rear housing mounted to said angled main housing at least partially below the water line, adapted to enclose and cool the rearward end of said intermediate shaft and said shifting wedge;

(r) an output shaft housing mounted to said angled main housing below the water line, corresponding to the acute downward and rearward angle of said output shaft, adapted to enclose and cool the rearward portion of said output shaft;

(s) a thrust redirection plate mounted upon and above said output shaft housing, at an acute angle, adapted to reflect and redirect force from a propeller mounted to said propeller mount; and (t) an angled skeg mounted upon and below said forward housing, angled main housing, and output shaft housing, adapted to shield said vertical-input outboard-motor angled-drive lower unit and a mounted propeller from obstacles and shallow water bottoms;

(ii) mounting said vertical-input outboard-motor angled-drive lower unit to an outboard motor engine having a vertical rotary power output;

(iii) mounting said outboard motor engine and said vertical-input outboard-motor angled-drive lower unit to a boat transom using a transom clamp steering bracket;

(iv) shifting between forward and reverse gears using said shift actuator rod; and (v) operating said outboard motor engine mounted to said vertical-input outboard-motor angled-drive lower unit for forward and reverse propulsion of the boat.

12. The vertical-input outboard-motor angled-drive lower unit method of claim 11, where said vertical-input outboard-motor angled-drive lower unit apparatus further comprises said output shaft below and at an acute angle of from 20 to 40 degrees inclusive to said intermediate shaft.

13. The vertical-input outboard-motor angled-drive lower unit method of claim 11, where said vertical-input outboard-motor angled-drive lower unit apparatus further comprises said output shaft below and at an acute angle of from 25 to 35 degrees inclusive to said intermediate shaft.

14. The vertical-input outboard-motor angled-drive lower unit method of claim 11, where said vertical-input outboard-motor angled-drive lower unit apparatus further comprises said output shaft below and at an acute angle of 30 degrees to said intermediate shaft.

15. The vertical-input outboard-motor angled-drive lower unit method of claim 11, where said input gear, said forward gear, and said reverse gear are bevel gears.

16. The vertical-input outboard-motor angled-drive lower unit method of claim 11, where said input gear, said forward gear, and said reverse gear are spiral bevel gears.

17. The vertical-input outboard-motor angled-drive lower unit method of claim 11, where said driving bevel gear and said driven bevel gear are spiral bevel gears.

18. The vertical-input outboard-motor angled-drive lower unit method of claim 11, where said thrust redirection plate further comprises a substantially planar structure extending forward and rearward and laterally sufficiently to extend past the operating area of a propeller mounted to said propeller mount.

19. The vertical-input outboard-motor angled-drive lower unit method of claim 11, where said thrust redirection plate further comprises a substantially planar structure extending at least 12 inches in a forward-rearward dimension and at least 10 inches laterally.

20. The vertical-input outboard-motor angled-drive lower unit method of claim 11, where said angled skeg extends downward at an angle greater than the angle of said output shaft.

* * * * *